US007325788B1

(12) United States Patent
Stanek et al.

(10) Patent No.: US 7,325,788 B1
(45) Date of Patent: Feb. 5, 2008

(54) CABLE SYSTEM

(75) Inventors: Thomas J. Stanek, Houston, TX (US); John J. Kelley, Houston, TX (US)

(73) Assignee: Mimi Management Services LP, Houston, TX (US)

( * ) Notice: Subject to any disclaimer, the term of this patent is extended or adjusted under 35 U.S.C. 154(b) by 141 days.

(21) Appl. No.: 11/370,552

(22) Filed: Mar. 8, 2006

(51) Int. Cl.
*E01F 15/00* (2006.01)

(52) U.S. Cl. ..... 256/13.1; 256/DIG. 5; 256/65.14

(58) Field of Classification Search ..... 256/13.1, 256/21, 62, 65.14, DIG. 5; 404/6, 9; 52/223.4, 52/244, 291
See application file for complete search history.

(56) References Cited

U.S. PATENT DOCUMENTS

| | | | | |
|---|---|---|---|---|
| 1,839,328 | A | 1/1932 | Moore | |
| 1,857,435 | A * | 5/1932 | Cole | 256/13.1 |
| 1,860,615 | A | 5/1932 | Kahn | |
| 1,877,074 | A | 9/1932 | Stanziale | |
| 2,907,552 | A | 10/1959 | Crone | |
| 3,185,445 | A * | 5/1965 | Broadway | 256/13.1 |
| 3,210,051 | A | 10/1965 | Case | |
| 3,451,657 | A | 6/1969 | Roberts | |
| 3,499,630 | A * | 3/1970 | Dashio | 256/13.1 |
| 3,521,862 | A | 7/1970 | Curtner | |
| 3,632,089 | A | 1/1972 | Smith | |
| 3,717,326 | A | 2/1973 | Leach et al. | |
| 4,075,473 | A | 2/1978 | Winston | |
| 4,887,691 | A * | 12/1989 | Rotondo | 181/210 |
| 4,979,817 | A * | 12/1990 | Crisp, Sr. | 256/13.1 |
| 5,022,782 | A | 6/1991 | Gertz et al. | |
| 5,039,066 | A * | 8/1991 | Stacey | 256/13.1 |
| 5,299,781 | A * | 4/1994 | Barrett et al. | 256/12.5 |
| 5,797,591 | A | 8/1998 | Krage | |
| 6,854,716 | B2 * | 2/2005 | Bronstad | 256/13.1 |
| 6,863,264 | B2 | 3/2005 | Johansson et al. | |
| 2005/0224776 | A1 * | 10/2005 | Alberson et al. | 256/13.1 |
| 2006/0017048 | A1 * | 1/2006 | Alberson et al. | 256/13.1 |
| 2006/0186393 | A1 * | 8/2006 | Santelli | 256/65.11 |

OTHER PUBLICATIONS

Ameristar Drawing Dated 01-??-04 Plan A Sheet 1 "Bollard Anchorage".
Ameristar Drawing Dated 03-??-04 Plan A Sheet 1 Rev 1 "Dead Man Anchorage".
Ameristar Drawing Dated 11-??-04 Plan A Sheet 1 N-12___ Cable System 8' High Gauntlet.

* cited by examiner

*Primary Examiner*—Daniel P. Stodola
*Assistant Examiner*—Joshua T Kennedy
(74) *Attorney, Agent, or Firm*—David W. Pettis, Jr., P.A.

(57) ABSTRACT

A cable system for erecting a barricade such as, for example, a security fence, on a support surface such as, for example, the perimeter of an area to be protected. The cable system is uniquely characterized by the structure of the hollow support posts, or bollards, and their fittings for the attachment of lengths of cable thereto to provide a barricade having high strength. Lengths of cable not only extend between adjacent posts, but each end of each cable length passes through the hollow void of each post for attachment thereto below the support surface. Each of the posts used in the system is preferably set in concrete, and the hollow void of each individual post is also filled with concrete. Also disclosed is a preferred structure for an individual post.

11 Claims, 9 Drawing Sheets

CABLE SYSTEM

BACKGROUND OF THE INVENTION

1. Field of the Invention

In a preferred embodiment, the present invention relates to a cable system for constructing a barricade above a support surface. According to the preferred embodiment, the cable system employs a plurality of hollow posts, each of which is uniquely constructed for placement within the support and including cable receivers whereby a plurality of cables may be attached in interconnecting relation with other posts in the system to form an extremely strong barrier. While the preferred embodiment is hereinafter disclosed and described with regard to its use along a highway right of way, it is to be understood that the scope of the invention is not to be limited thereby, for the cable system of this invention could be adapted for a wide variety of uses in constructing and erecting barricades.

2. Description of the Prior Art

It is certainly old and well known to erect some form of barricade along a highway's right of way for the purpose of preventing a vehicle from leaving the road.

Frequently, such barricades are also erected in the median between multi-lane highways. Such barricades typically comprise a plurality of posts set in spaced apart relation to each other with wood or metal rails extending between the posts, and, in some installations, cables extend between the posts in combination with, or instead of, rails. Prior art also discloses the use of spring-biased posts so that they will bend or give upon impact, rather than breaking.

The prior art also teaches that it is relatively common to provide additional securement for the end posts, in order to strengthen the barricade further. The end securement frequently takes the form of two rods and a turnbuckle, with one rod segment fixed to the post and a second segment, at the other side of the turnbuckle, buried in the support surface. Still other examples known in the prior art employ hollow rails between the posts, with cables threaded through the hollow portion of each rail.

Notwithstanding the existence of a great variety of such barricade structures, both the installation and maintenance of prior art devices are quite cumbersome and expensive. In addition, both federal and state authorities have established testing procedures which must be passed in order for a barricade system to be installed along federal and/or state highways. As the permitted weight and speed of vehicles have increased, so have the safety standards required of barricade systems. Frankly, whether or not many of the barricade systems disclosed in existing patent literature could effectively and economically satisfy today's standards is an issue of real concern.

It is therefore clear that there remains a need for a barricade system that is acceptable not only for highway right of way use, but also that could be adapted for additional barricade purposes. Unfortunately, this is particularly true in today's age of heightened security where the threat of a vehicle's breaking through a security barricade is a real and present threat.

SUMMARY OF THE INVENTION

In one preferred embodiment, the present invention relates to a cable system for constructing a barricade above a support surface. The cable system of this preferred embodiment comprises a plurality of hollow posts that are preferably formed from steel. According to the preferred embodiment, each of the posts is formed of one half inch steel and is about 10 inches square and 152 inches long. The post is open from its top edge to its bottom edge and a series of cable apertures are formed through opposed sides of each post for the purpose of inserting cables therethrough. Fixed at the bottom of each post is a base plate, preferably formed from a one inch thick plate of steel that is about 12 inches wide, front to back and about 20 inches wide side to side. A plate is affixed to the bottom edge of each post such that its major dimension (width) extends outwardly from the sides of the post wherein the cable apertures have been formed.

An eye bolt is fixed to each plate with the eye extending upwardly from the plate in substantially parallel relation to the left and right side of each post. Fixed to each of the eyes, on opposite sides of each post, is a cable receiver, or clevis, into which one end of a cable will be fixed and retained as more fully described below.

One end of each clevis is attached to a corresponding eye of each eye bolt, and the free end of each clevis is positioned in communicating relation with a corresponding one of a pair of lower cable apertures formed through opposed side walls of each post.

Still with regard to a preferred embodiment for this invention, each post is set into a hole provided in the support surface, using standard steel reinforcing according to known construction techniques, with a first pour of concrete that extends upwardly in surrounding relation to the base plate and lower segment of each post up to, but below, the eye of the opposed eye bolts associated with each posts. After this initial concrete pour has been made, the two cable retainers, or clevises, may be attached to respective eyes, and installation of cables may commence. In this regard, it should be further noted that according to a preferred construction hereinafter described in greater detail, this cable system includes a series of seven, longitudinally spaced, posts. Obviously, two of the posts would be at the end of the segment, with five intermediate posts.

Each of the posts of this preferred cable system further comprise two additional opposed pairs of cable apertures formed through opposed left and right sides of each post. A pair of middle cable apertures are formed upwardly from the lower cable apertures about 90 inches from the bottom edge of each post. An opposed pair of upper cable apertures are similarly formed about 108 inches above the bottom edge of each post. According to the preferred construction, all three opposed pairs of cable apertures define a substantially teardrop perimeter with the smaller radius of the middle and upper cable apertures being disposed toward the bottom edge of the post, and the smaller radius of the lower cable apertures being disposed toward the top edge of each post. For the purpose of guiding and retaining cables that are ultimately passed through each of the three pairs of cable apertures, a substantially U-shaped saddle is placed transversely through each aperture at the apex of the smaller radius. While the use of saddles at the lower cable apertures may not be necessary, their use at both the middle and upper apertures is preferred.

Once the seven posts have been set, as described above with regard to the first concrete pour, cable segments are attached to the post in a preferred, predetermined arrangement. This preferred arrangement is disclosed in detail hereinafter, but it is to be emphasized that the arrangement of cables from post to post provided in the detail description of a preferred embodiment is not intended as a limiting factor to the scope of this invention. Alternative arrangements for the cable segments could be accomplished while still falling within the scope of the present invention. The preferred cable is steel of about one inch diameter, though other sizes may be used in other embodiments.

Once the various cable segments have been attached from post to post, the preferred embodiment further contemplates disposing one of a plurality of cover plates around each of the cable apertures in order to close each aperture, at least substantially, but not necessarily completely. After the cover plates have been attached by any suitable means such as, for example, bolts, brackets, or welding, a second concrete pour is made to fill each of the post holds, and concrete is poured into the hollow defined by the sides of each post. Therefore, cable segments that actually pass into and through the hollow of each post are further strengthened by the concrete placed there around.

A cable system constructed and erected in accord with this preferred embodiment has been tested and shown to meet appropriate standards.

The invention accordingly comprises an article of manufacturer possessing the features, properties, and the relation of elements which will be exemplified in the preferred article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

In the following detailed description it is to be noted that a preferred system and a preferred post construction are described. This description of preferred embodiments is made for the purpose of providing the inventors' present best mode for practicing the invention, the scope of which is set forth in the claims. It is also to be understood that terminology used in describing the preferred embodiments shall be interpreted as illustrative and not in a limiting fashion.

Figure 1:
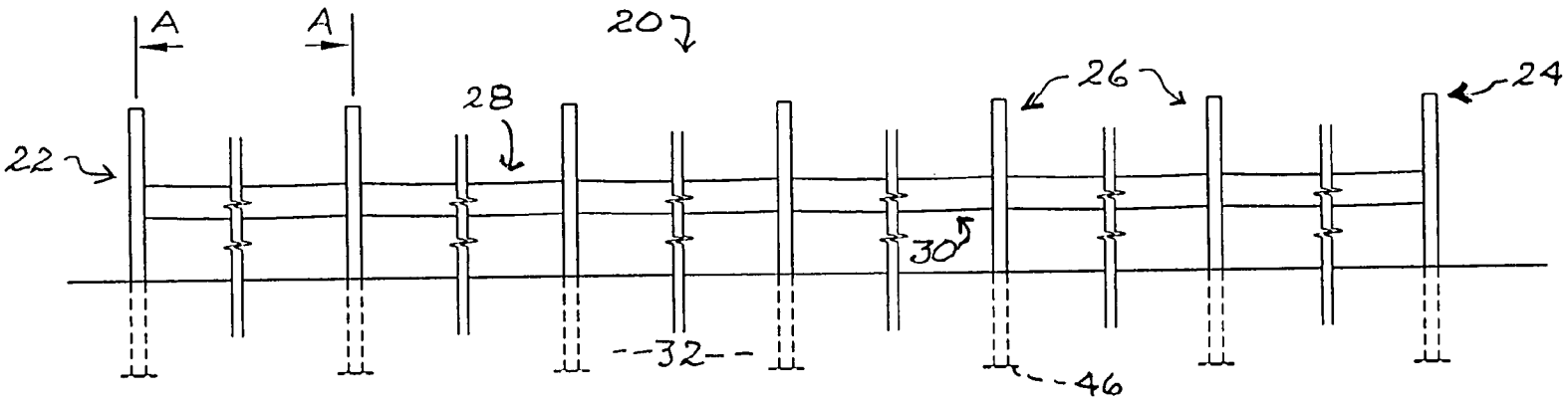
FIG. 1 is a front elevation of an installation of a preferred embodiment of this invention.
Figure 2:
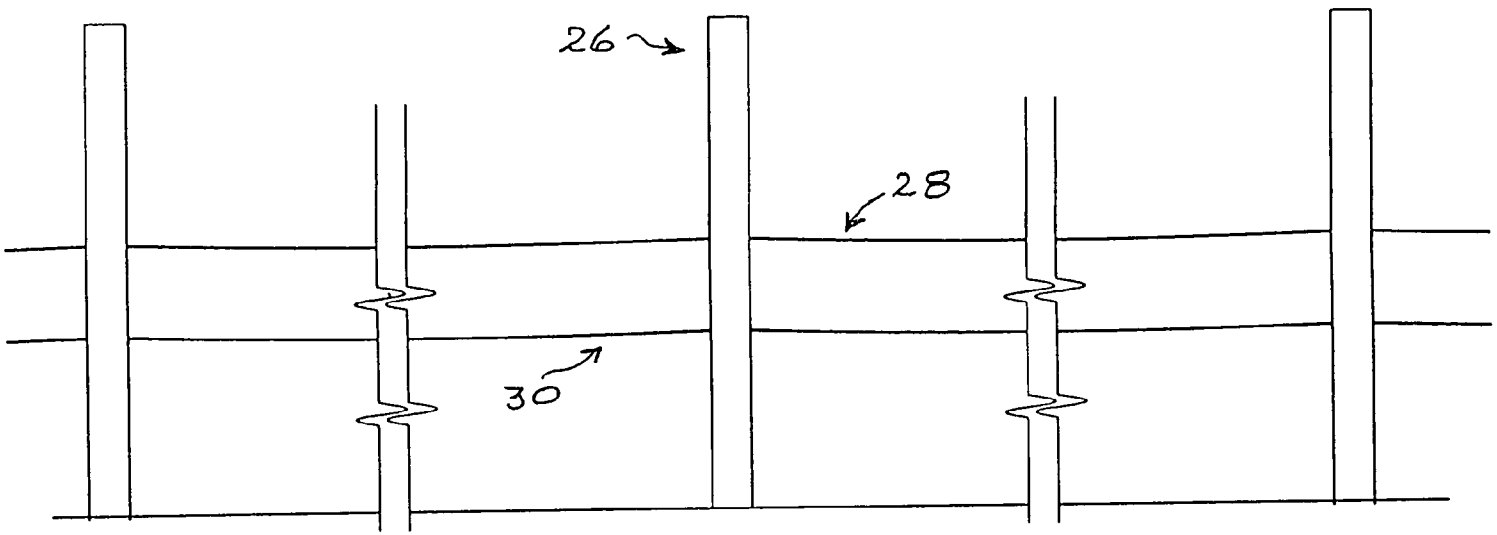
FIG. 2 is a partial detail of the installation depicted in the view of FIG. 2.
Figure 5:
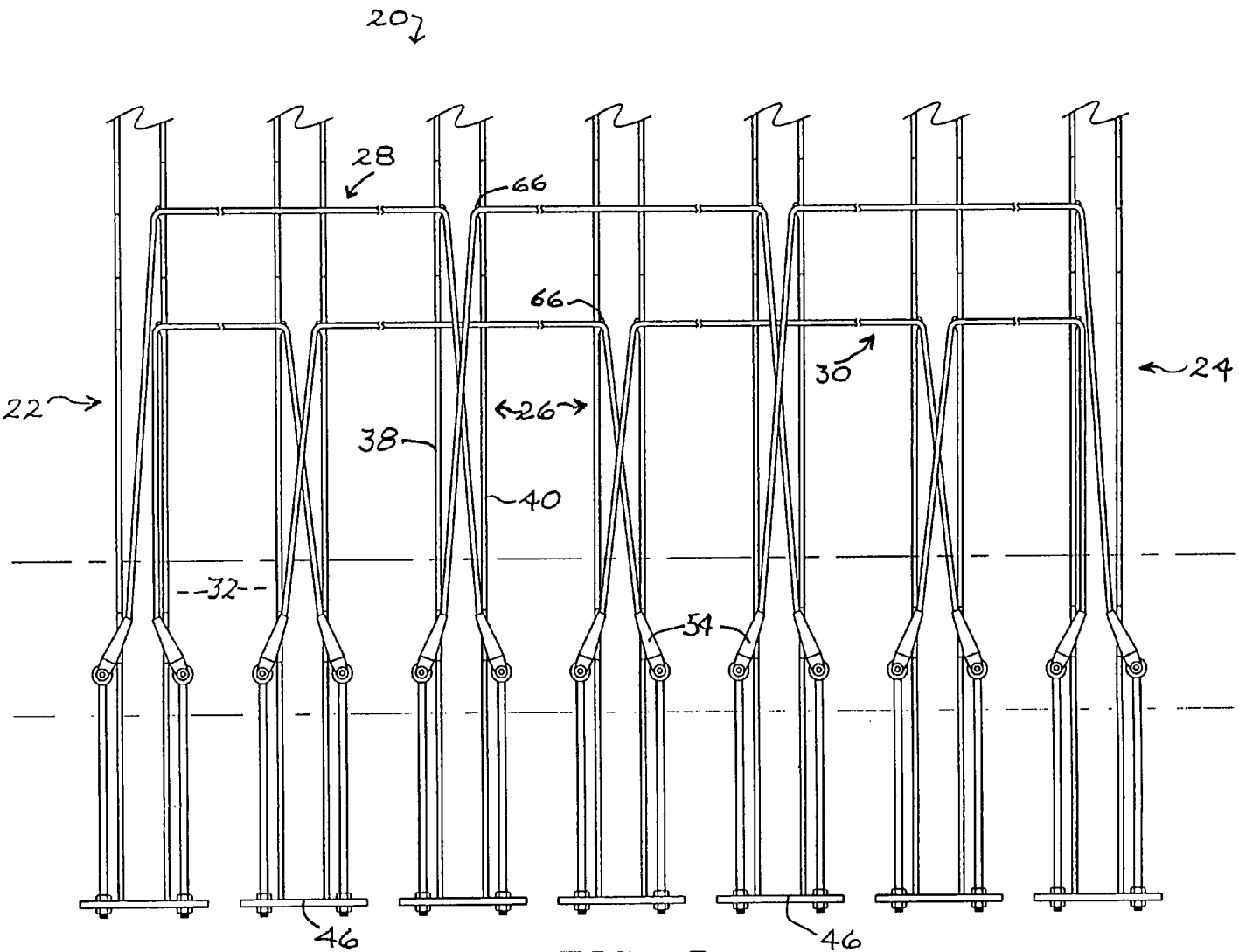
FIG. 5 is a front elevation, partially in section, of a preferred installation of the cable system of this invention illustrating a preferred cable arrangement for seven posts.

The views of FIGS. 1, 2 and 5 illustrate a preferred cable system of this invention, generally indicated as 20. As best seen in the views of FIGS. 1 and 5, preferred cable system 20 comprises a series of seven posts, with the end posts generally indicated at 22 and 24, and the five intermediate posts generally indicated as 26. The views of FIGS. 1 and 2 further illustrate the use of upper cables and lower cables, generally indicated as 28 and 30, respectively. Finally, FIGS. 1 and 2 show placement of cable system 20 into and above a support surface generally indicated as 32. While end posts 22 and 24 are generally indicated by reference numerals different from the designation of intermediate posts 26, the following detailed description will make clear that the structure of all posts 24, 26 and 28, is identical. As indicated by arrows A in the view of FIG. 1, a preferred spacing between each of the posts 22, 24 and 26 is about 32 feet 6 inches, but this spacing is not a limiting factor to the scope of the present invention.

Inviting attention to the views of FIGS. 3, 4, and 6-11, a preferred construction for one of the posts 26 is provided. In accord with the preferred embodiment, post 26 is preferably formed from one half inch thick steel, defines a length of about 152 inches, and comprises a front side 34, a rear side 36, a left side 38, and a right side 40. The length of post 26 is defined by the distance between top edge 42 and bottom edge 44. Each of the sides is about 10 inches in width, and the interior of post 26 is hollow.

A base plate 46 is attached across bottom edge 44 of post 26, preferably by welding. According to this preferred embodiment, base plate 46 is formed of one inch thick steel and is sized to extend outwardly from left side 38 and right side 40 of each of the posts 26. Therefore, base place 46 effectively closes the hollow interior of post 26 at bottom edge 44. An eye bolt 48 is attached to base plate 46 at first end 50 and extends upwardly from base plate 46, terminating in a distal end comprising an eye 52. As clearly seen in the views of FIGS. 7 and 8, one eye bolt 48 is disposed in substantially parallel, spaced apart relation to left side 38, and another eye bolt 48 is similarly placed along right side 40. While this preferred embodiment illustrates the attachment of first end 50 to base plate 46 by nuts, alternative attachments may be provided.

Figure 4:
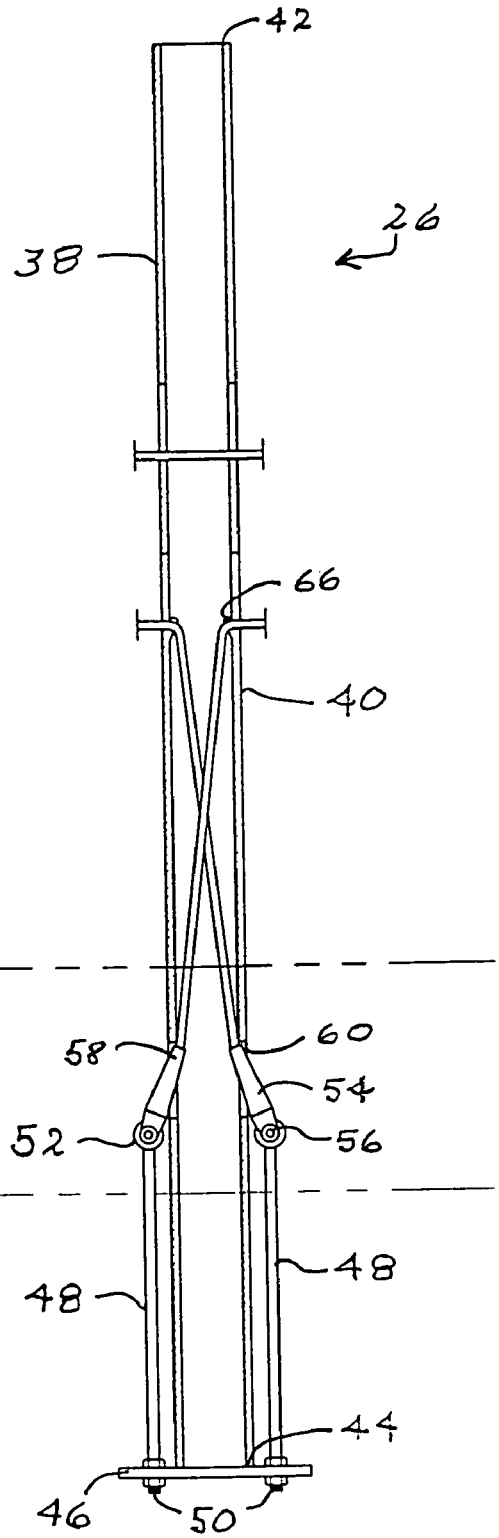
FIG. 4 is a front elevation of the post shown in FIG. 3.
Figure 9:
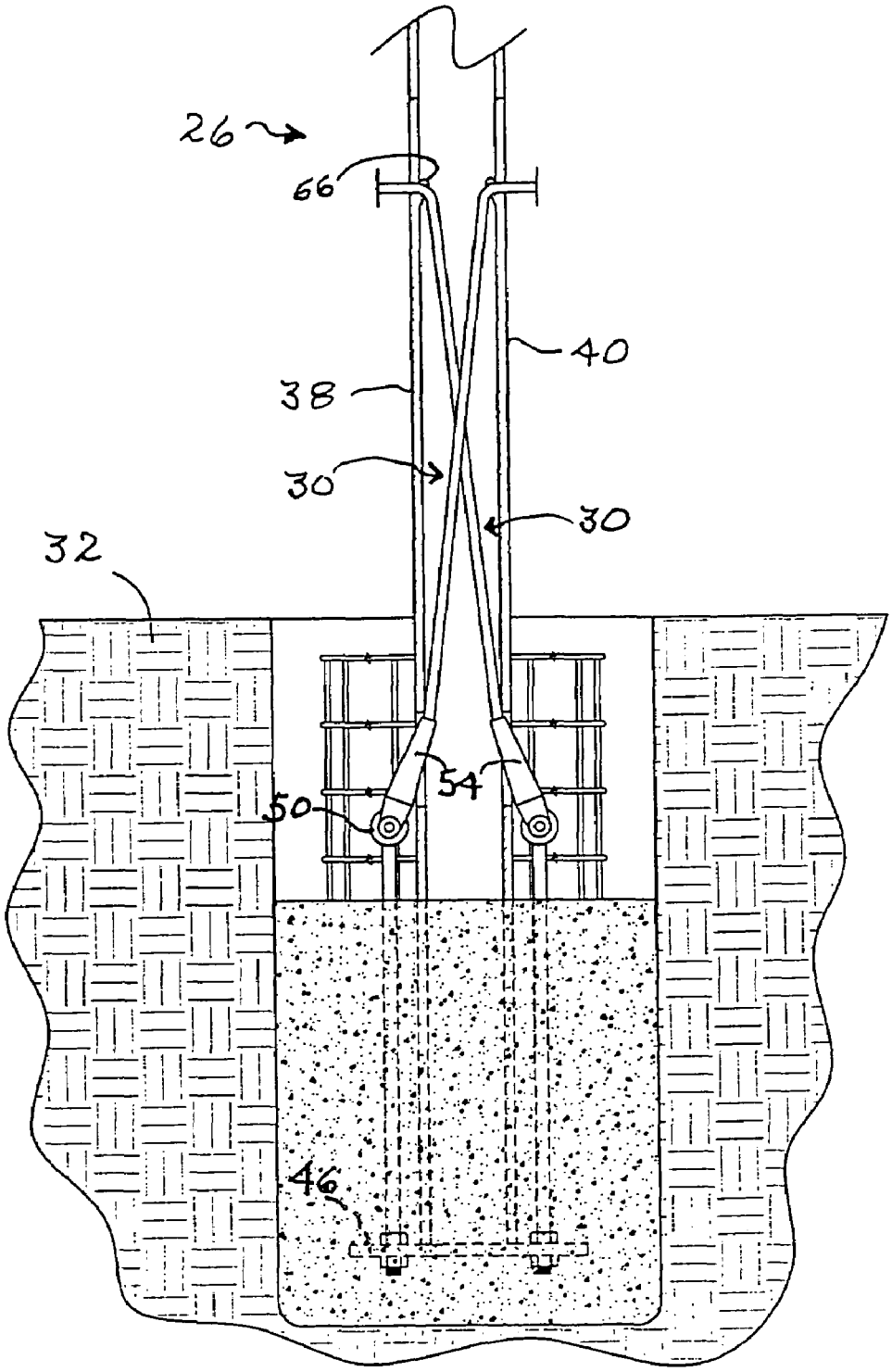
FIG. 9 is a view similar to that of FIG. 8 showing cable attachment after the first concrete pour.

Referring next to the views of FIGS. 4 and 9, it can be seen that a cable receiver, or clevis, 54 is attached at its first end 56 to each of the eyes 52. Second end 58 of each cable receiver 54 receives and retains an end of one of the cables 28, 30, as more fully set forth hereinafter.

Figure 3:
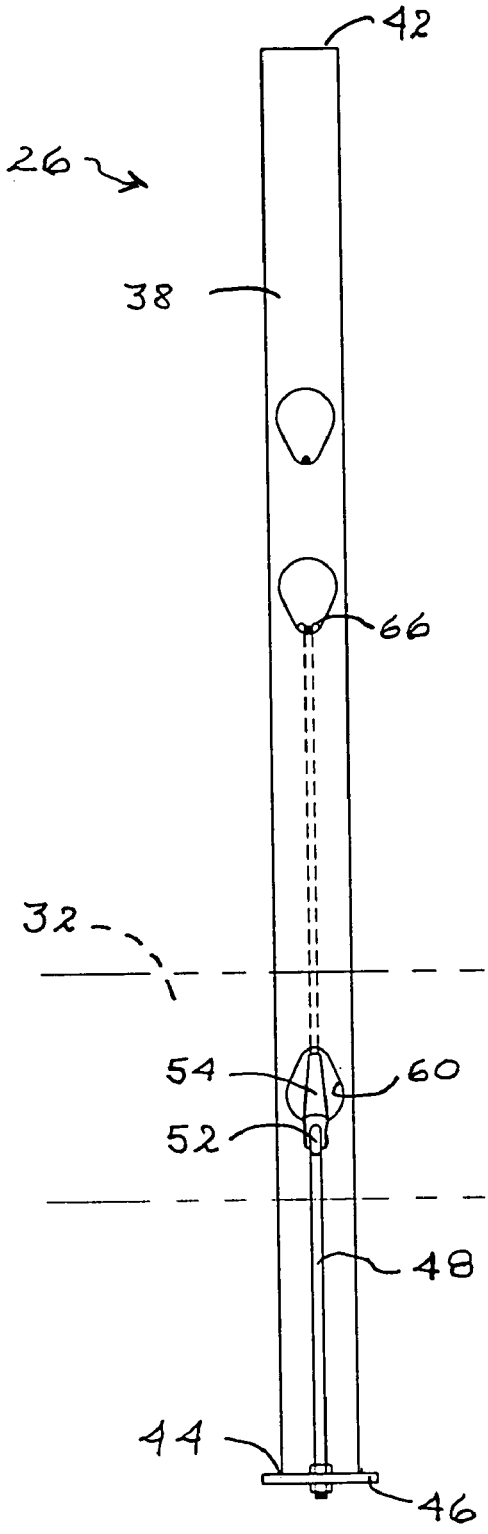
FIG. 3 is as side elevation of a preferred embodiment of one post.
Figure 10:
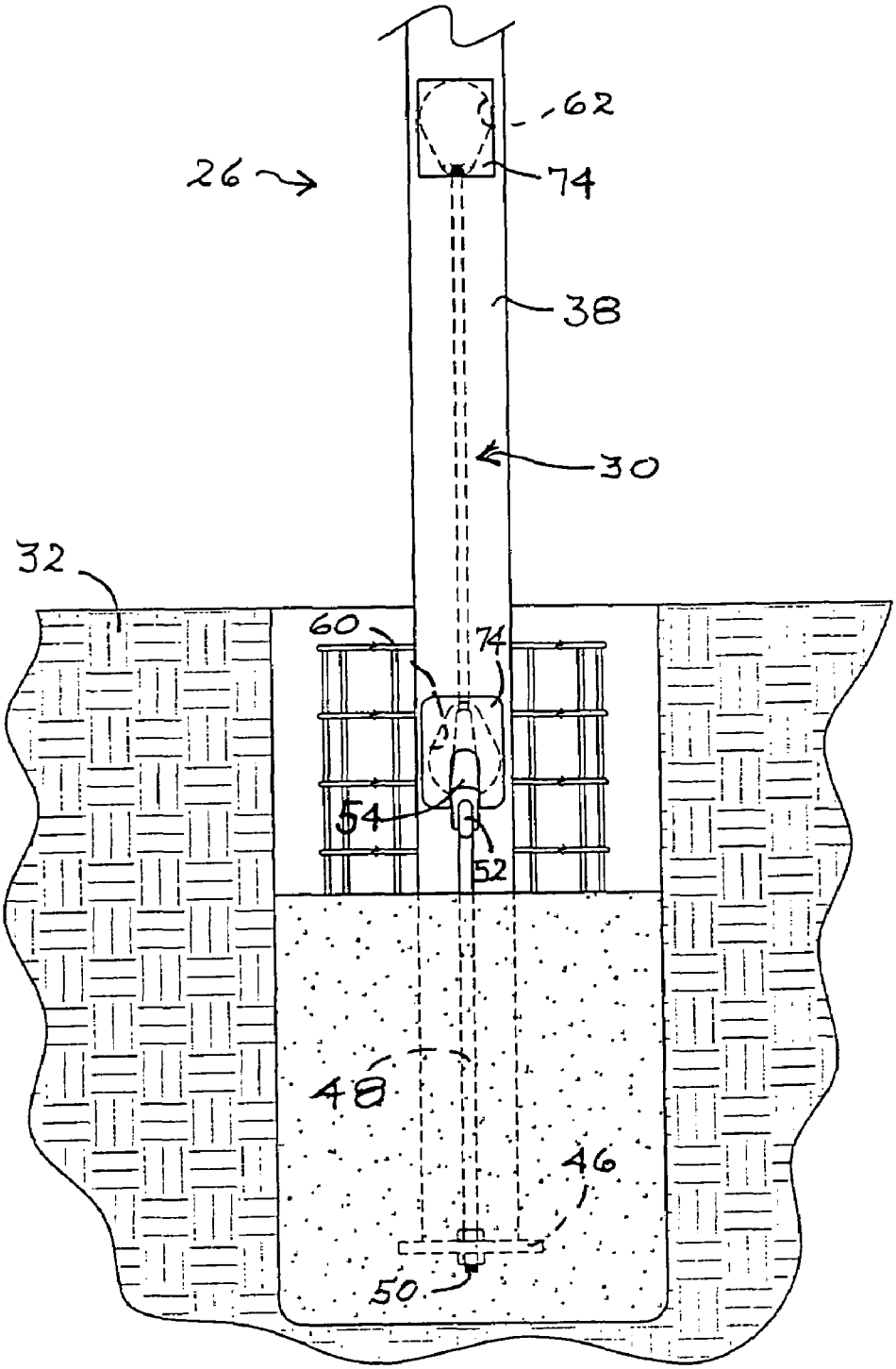
FIG. 10 is a side view of the post shown in FIG. 9.
Figure 11:
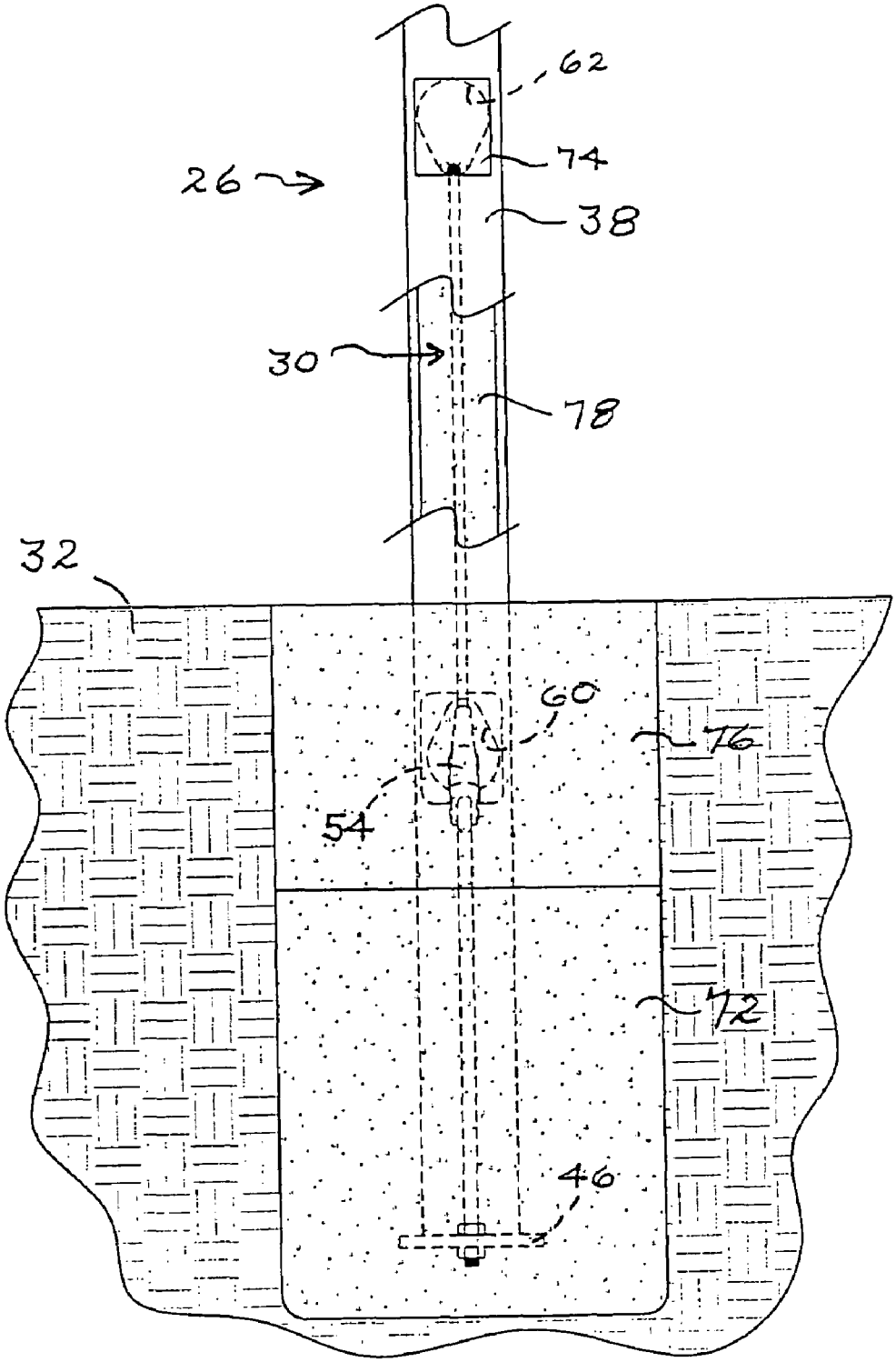
FIG. 11 is a side view of the post shown in FIG. 10, partially in section, after the final concrete pour.

The views of FIGS. 3 and 4 illustrate the placement of a plurality of cable apertures in spaced apart relation along the length of post left side 38 and post right side 40. All of the cable apertures preferably define a teardrop perimeter. As best seen in the views of FIGS. 3 and 4, a pair of opposed lower cable apertures 60 are formed in opposed relation to each other, one on left side 38 and the other on right side 40. It can also be seen that lower cable apertures 60 are in communicating relation with second end 58 of a cable receiver 54. It can also be seen that the smaller radius of the perimeter is oriented upwardly, in the direction of top edge 42. Each of the posts 26 further comprise a pair of opposed middle cable apertures 62 with one of the middle cable apertures 62 being formed through left side 38 and the other of said middle cable aperture 62 being formed in opposed relation thereto through right side 40. As best seen in the view of FIGS. 10 and 11, the smaller radius of middle cable aperture 62 is oriented downwardly, toward bottom edge 44. Referring to the views of FIGS. 3-5, one can see that this preferred embodiment further comprises an opposed pair of upper cable apertures 64. Referring to the views of FIGS. 3 and 4, it can be seen that each of the middle cable apertures 62 preferably comprises a cable guide, or saddle, 66 disposed in substantially transverse relation to left side 38 and right side 40 at the smaller radius of each of the middle cable aperture 62. Cable guides 66 may also be provided for each of the upper cable apertures 64 as shown in the view of FIG. 5. However, it is to be understood that the use of cable guides 66, while preferred for middle cable aperture 62 and upper cable apertures 64, is not required for successful installation and use of cable system 20. Cable guide 66 are substantially U-shaped, formed of steel, and may be attached to the smaller radius of middle cable aperture 62 and upper cable apertures 64 by any suitable means, preferably by welding.

Figure 6:
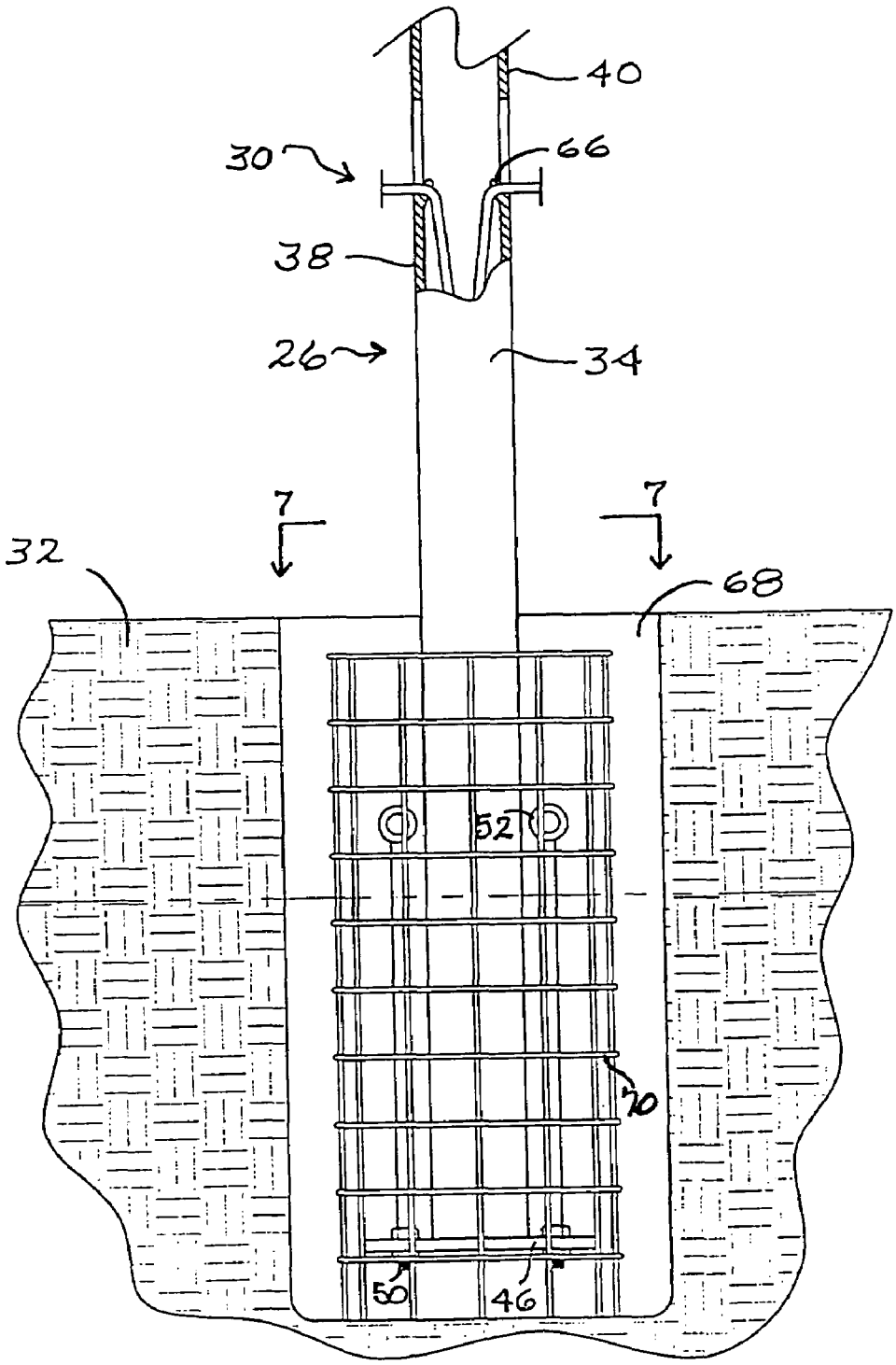
FIG. 6 is a detail partial elevation showing placement of a single preferred post in the support surface, with the post partially in section.
Figure 7:
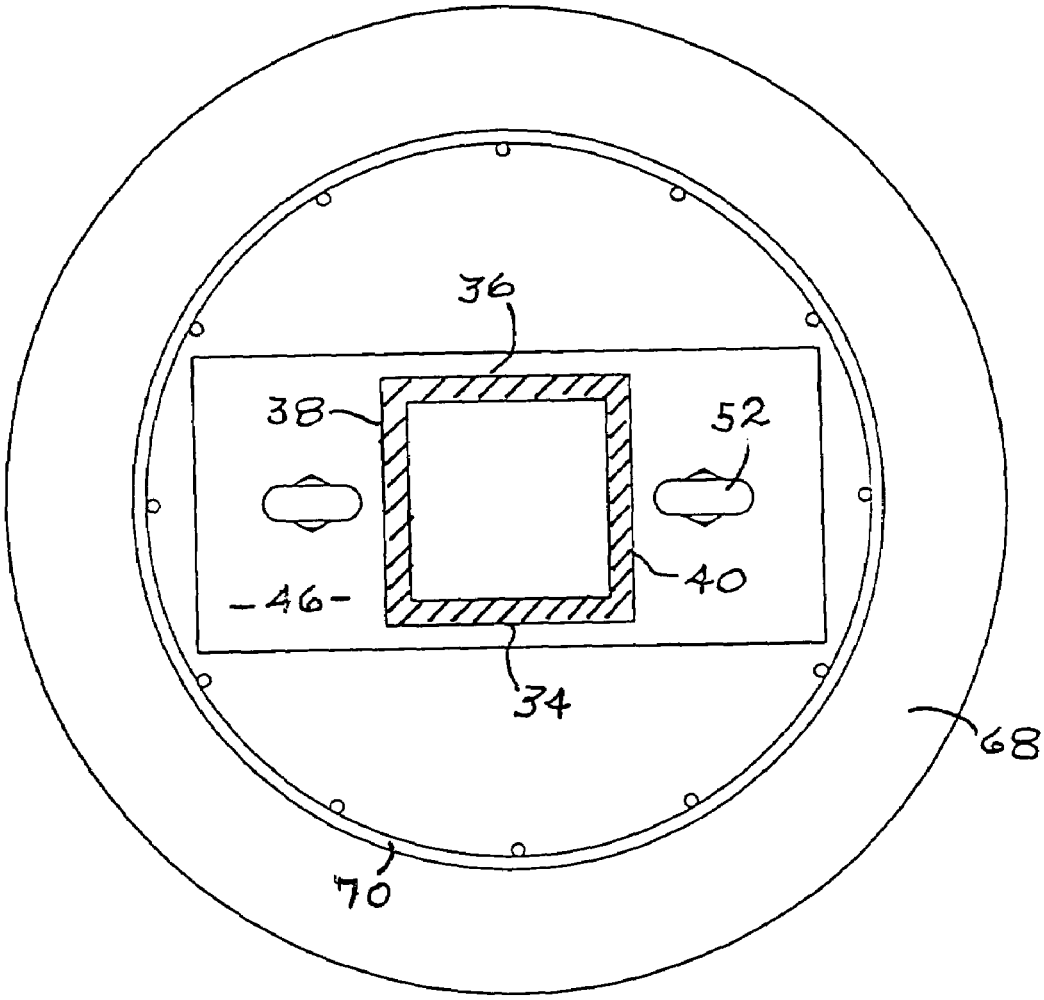
FIG. 7 is a top plan view taken along line 7-7 in FIG. 6.
Figure 8:
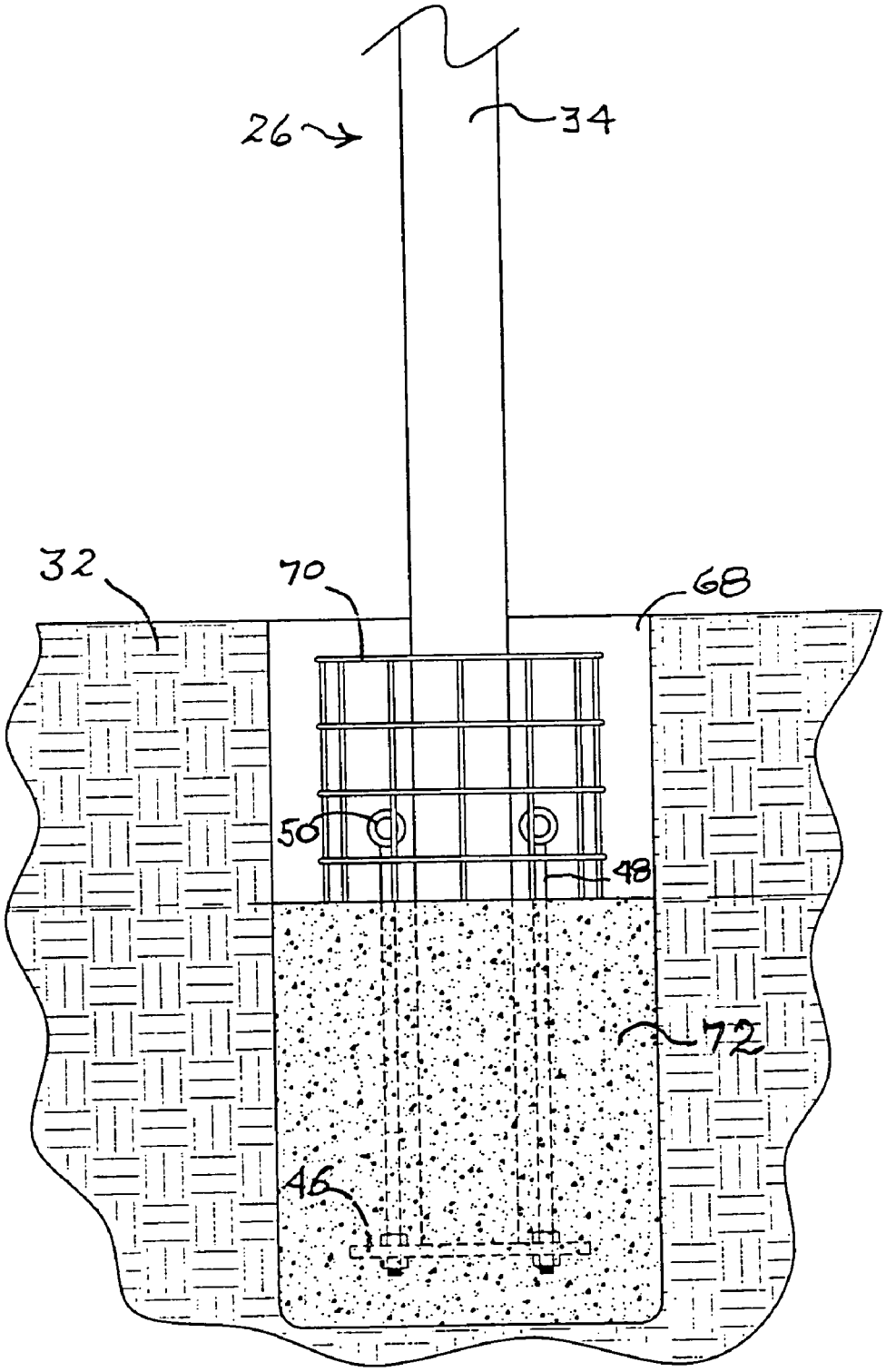
FIG. 8 is a view similar to that of FIG. 6 showing the first concrete pour.

As shown in the views of FIGS. 6-11, each of the posts 22, 24 and 26, is mounted in support surface 32 according to standard construction techniques. A hole 68 is prepared, and reinforcing mesh 70 is inserted in substantially surrounding relation to the post 26, extending above each of the eyes 52. When post 26 has been placed in hole 68 as shown in the view of FIG. 6, a first concrete pour 72 is made as shown in the view of FIG. 8, and each of the posts is allowed to set in first concrete pour 72. Next, the cable receivers 54 are attached to corresponding eyes 50 as shown in the view of FIG. 9 for the attachment of upper cables 28 and lower cables 30. While only lower cables 30 are shown in FIGS. 6 and 8-11, the attachment and placement of upper cables 28 is clearly shown in the view of FIG. 5, according to this preferred embodiment.

The view of FIG. 5 illustrates a preferred arrangement for attaching upper cables 28 and lower cables 30 in the installation of this preferred cable system 20. As clearly shown in the view of FIG. 5, one of the lower cables 30 in end post 22 and in end post 24 is attached to a cable receiver 54 in a next adjacent post 26. Still with regard to end posts 22 and 24, their upper cables 28 extend upwardly, through an upper cable aperture 64, passing completely through both upper cable apertures 64 of an adjacent post 26, and then into an upper cable aperture 64 of the next post 26, and downwardly to one of the cable receivers 54 in that third post 26. It is only from the end posts 22 and 24 that a lower cable 30 is attached to an immediately adjacent post 26. In all other instances, as depicted in the preferred embodiment of FIG. 5, upper cables 28 and lower cables 30 extend from one post, through an intermediate post, and are attached to what may be termed a third post. It should also be noted that in this preferred arrangement, shown in FIG. 5, when a cable is attached to a cable receiver 54 associated with left side 38 of the post, the terminal end of that cable is associated and received by a cable receiver 54 disposed adjacent right side 40 of its post. Therefore, upper cables 28 and lower cables 30 "cross" inside the hollow of each of the posts, resulting in stronger fixation once the final concrete pour has been made.

Returning to the views of FIGS. 9 and 10, after upper cables 28 and lower cables 30 have been attached as described above, a cover plate 74 is preferably disposed in substantially surrounding, enclosing relation to each of the cable apertures, 60, 62 and 64. The cables 28 and 30 are tensioned to substantially eliminate any sagging, and a second concrete pour 76 is made, as shown in the view of FIG. 11. Finally, a post concrete pour 78 is made to substantially fill the hollow void defined by each of the posts 22, 24 and 26. Once all of the concrete has secured, the preferred cable system 20 is complete.

It will thus be seen that the object set forth above, among those made apparent from the preceding description of a preferred embodiment, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described in a preferred embodiment, and all statements of the scope of the invention which, as a matter of language, might be said to fall there between.

Now that the invention has been described,

What is claimed is:

1. A cable system for constructing a barricade above a support surface, said cable system comprising: a plurality of hollow posts disposed on the support surface in longitudinally spaced apart relation to each other, each one of said plurality of posts being defined by a top edge, a bottom edge, a front side, a rear side, a left side and a right side, with the length of each one of said plurality of posts being defined by the distance between said top edge and said bottom edge; a plurality of post base plates, each one of said plurality of base plates being attached to a corresponding one of said plurality of posts at said bottom edge in substantially transverse relation to said length; a plurality of opposed pairs of eye bolts, each one of said opposed pairs having a first end attached to a corresponding one of said plurality of base plates and a distal end comprising an eye extending upwardly from said base plates in substantially parallel relation to said length of each one of said plurality of posts, one of each one of said pair of eye bolts being disposed in spaced apart relation to said left side of each one of said plurality of posts and the other of each one of said pair of eye bolts being disposed in spaced apart relation to said right side of each one of said plurality of posts; a plurality of cable receivers, each one of said plurality of cable receivers having a first end and a second end, each one of said cable receiver first ends being connected to a corresponding one of said eyes of each one of said plurality of eye bolts; a plurality of left lower cable apertures, one of each one of said plurality of left lower cable apertures being formed through each one of said left sides of each one of said plurality of posts and a corresponding plurality of right lower cable apertures, one of each one of said plurality of right lower cable apertures being formed through each one of said right sides of each one of said plurality of posts; a plurality of left middle cable apertures, one of each one of said plurality of left middle cable apertures being formed through each one of said left sides of each one of said plurality of posts above a corresponding one of said left lower cable apertures and a corresponding plurality of right middle cable apertures, one of each one of said plurality of right middle cable apertures being formed through each one of said right sides of each one of said plurality of posts above a corresponding one of said lower cable apertures; a plurality of left upper cable apertures, one of each one of said plurality of left upper cable apertures being formed through each one of said left sides of each one of said plurality of posts above a corresponding one of said left middle cable apertures and a corresponding plurality of right upper cable apertures, one of each one of said plurality of right upper cable apertures being formed through each one of said right sides of each one of said plurality of posts above a corresponding one of said right middle cable apertures; and a plurality of cables, each one of said plurality of cables having a first cable end and a second cable end, said first cable end of each one of said plurality of cables being attached to said second end of one of said cable receivers of one of said posts and said second cable end of each one of said plurality of cables being attached to said second end of one of said cable receivers of a different one of said posts.

2. A cable system as in claim 1 wherein a segment of said length of each of said plurality of posts including said lower left and lower right cable apertures is disposed below the support surface.

3. A cable system as in claim 1 wherein each one of said second ends of each one of said cable receivers is in communicating relation to a corresponding one of said lower cable apertures in receiving relation to one of said ends of one of said plurality of cables, whereby one of said ends of each of said plurality of cables is received and retained in a corresponding one of said cable receivers.

4. A cable system as in claim 1 wherein a segment of said length of each of said plurality of posts including said middle left and middle right cable apertures is disposed above the support surface.

5. A cable system as in claim 1 wherein each of said plurality of middle cable apertures and each of said plurality of upper cable apertures defines a substantially teardrop perimeter, with the smaller radius of said teardrop perimeter being disposed toward said bottom edge of each of said plurality of posts.

6. A cable system as in claim 5 further comprising a plurality of cable guides, one of each of said plurality of cable guides being disposed at said smaller radius of each of said plurality of middle cable apertures and each of said upper cable apertures, whereby a segment of one of said plurality of cables passing through one of said middle cable apertures and a segment of another one of said plurality of cables passing through one of said upper cable apertures will be received in a corresponding one of said plurality of cable guides.

7. A cable system as in claim 1 further comprising a plurality of cover plates, one of each of said plurality of cover plates being disposed in substantially surrounding, enclosing relation to each one of said cable apertures.

8. A cable system as in claim 7 further comprising concrete filling said hollow of each one of said plurality of posts from said base plate to said top edge.

9. A post used for erecting a cable system barricade on a support surface, said post comprising: a top edge, a bottom edge, a front side, a rear side, a left side and a right side, a length of said post being defined by the distance between said top edge and said bottom edge, said post further comprising a hollow interior defined by said front, rear, left and right sides; a post base plate attached at said bottom edge in substantially transverse relation to said length; an opposed pair of eye bolts, each one of said opposed pair having a first end attached to said base plate and a distal end comprising an eye extending upwardly from said base plate in substantially parallel relation to said length, one of said pair being disposed in spaced apart relation to said left side of said post and the other of said pair being disposed in spaced apart relation to said right side of said post; a pair of cable receivers each having a first end and a second end, each of said cable receiver first ends being connected to a corresponding one of said eyes of each one of said pair of eye bolts; a left lower cable aperture formed through said post left side in communicating relation to one of said cable receiver second ends; a right lower cable aperture formed through said post right side in communicating relation to the other of said cable receiver second ends; a left middle cable aperture formed through said post left side above said left lower cable aperture; a right middle cable aperture formed through said post right side above said right lower cable aperture; a left upper cable aperture formed through said post left side above said left middle cable aperture; and a right upper cable aperture formed through said post right side above said right middle cable aperture.

10. A post as in claim 9 wherein each of said left and right middle cable apertures and each of said left and right upper cable apertures defines a substantially teardrop perimeter, with the smaller radius of said teardrop perimeter being disposed toward said bottom edge of said post.

11. A post as in claim 10 further comprising a plurality of cable guides, one of each of said plurality of cable guides being disposed at said smaller radius of each of said left and right middle cable apertures and at said smaller radius of each of said left and right upper cable apertures.

* * * * *

UNITED STATES PATENT AND TRADEMARK OFFICE

CERTIFICATE OF CORRECTION

PATENT NO. : 7,325,788 B1
APPLICATION NO. : 11/370552
DATED : February 5, 2008
INVENTOR(S) : Thomas J. Stanek et al.

It is certified that error appears in the above-identified patent and that said Letters Patent is hereby corrected as shown below:

Title Page, Item (73) - in the name of the Assignee, delete "Mimi" and insert therefore --MMI--.

Signed and Sealed this

Twenty-seventh Day of May, 2008

JON W. DUDAS
*Director of the United States Patent and Trademark Office*